US005714707A

United States Patent [19]

Ruia

[11] Patent Number: 5,714,707

[45] Date of Patent: Feb. 3, 1998

[54] PROCESS AND APPARATUS FOR DEMILITARIZATION OF SMALL CALIBER PRIMED CARTRIDGE CASES

[75] Inventor: Anup Ruia, Beckley, W. Va.

[73] Assignee: Talon Manufacturing Company, Inc., Paw Paw, W. Va.

[21] Appl. No.: 645,088

[22] Filed: May 13, 1996

[51] Int. Cl.[6] ..... F42B 33/04; F42B 33/06

[52] U.S. Cl. ..... 86/49; 86/1.1; 86/50

[58] Field of Search ..... 86/1.1, 36–38, 86/49, 50; 588/208

[56] References Cited

U.S. PATENT DOCUMENTS

| | | | |
|---|---|---|---|
| 236,611 | 1/1881 | Morris | 86/36 |
| 1,492,922 | 5/1924 | Knight | 86/49 |
| 1,492,924 | 5/1924 | Knight | 86/49 |
| 1,492,925 | 5/1924 | Knight | 86/49 |
| 1,492,956 | 5/1924 | Poots | 86/49 |
| 1,706,938 | 3/1929 | Roberts | 86/49 |
| 1,958,420 | 5/1934 | Deck et al. | 86/49 |
| 2,824,482 | 2/1958 | North | 86/49 |

FOREIGN PATENT DOCUMENTS

| | | | |
|---|---|---|---|
| 563930 | 11/1932 | Germany | 86/36 |
| 242011 | 11/1925 | United Kingdom | 86/49 |

*Primary Examiner*—Harold J. Tudor

*Attorney, Agent, or Firm*—Rothwell, Figg, Ernest & Kurz

[57] ABSTRACT

Small caliber primed cartridge cases are demilitarized by removing explosive primer mix from the cases. The cases are flushed with a chemical solution, preferably a sulfuric acid solution, to dissolve the binder material which holds the components of the explosive primer mix together. Upon dissolution of the binder material, e.g. gum arabic, the primer mix breaks apart into particles which flow forward through the flash hole(s) in the case and exit the open end of the case. The solution is agitated into a turbulent state so as to enter the open end of the hollow case and sufficiently contact the primer mix through the flash hole(s). The treated cases are chemically deprimed in that the explosive primer mix has been removed therefrom; additionally, any primer mix which might remain in the case is rendered inert by the acid solution. The deprimed cases may then be rinsed and dried and used for reloading applications or scrap recovery. The process is particularly suitable for demilitarizing brass cartridge cases as the sulfuric acid solution desensitizes and removes the primer mix without inducing stress corrosion cracking in the cases, which is a significant problem in prior art processes of chemically treating brass.

22 Claims, 5 Drawing Sheets

PROCESS AND APPARATUS FOR DEMILITARIZATION OF SMALL CALIBER PRIMED CARTRIDGE CASES

BACKGROUND OF THE INVENTION

1. Field of the Invention

The present invention relates generally to the demilitarization of live ammunition and, more particularly, to the removal and desensitization of primer mix from small caliber cartridge cases.

2. Description of Background Art

Ammunition is stored under various conditions for various lengths of time. As a result of the varying conditions to which the ammunition is subjected, for example, changing temperature, moisture, pressure, etc., the primers which are located in the cartridge cases or casings (and include explosive primer mix) often become unreliable and/or ineffective, rendering the ammunition unfit for use. Consequently, such ammunition has to be demilitarized, i.e. the explosive materials therein must be removed or rendered inert; the cartridge cases may then be discarded or recycled. Further, the closing of various military depots has resulted in an increased need for a safe, ecologically acceptable, and economical process for the demilitarization of ammunition which is old or does not meet specifications.

As noted above, live cartridge cases include a primer which contains primer mix for igniting the propellant (e.g., gunpowder) stored in the case. The primer mix is the only class 1.1 explosive present in small caliber ammunition (less than 0.30 caliber). Accordingly, primer mix poses a significant explosive hazard during the demilitarization of live ammunition, i.e., ammunition which has not been fired or detonated.

FIG. 1 depicts a conventional small caliber cartridge 10 including a case 20 and a bullet 40. The case contains propellant 30 (such as gunpowder) and a primer, indicated generally by reference numeral 50, which typically includes a pellet of primer mix 54, the components of the mix being held together by a binder material. The rear portion 24 of case 20 includes a recess in which the primer 50 is positioned. The primer 50, as known in the art, typically includes a cup-shaped member 52 placed with its open end facing toward the propellant 30. The cup 52 includes a small amount of explosive primer mix 54 located adjacent to an anvil 56, the anvil 56 overlying the annular ledge 28 which includes an opening therethrough forming a flash hole 26. The primer mix contains various constituents held together by a binder material, such as gum arabic. As is known in the art, impact against the outer surface of the cup 52 presses the primer mix 54 against the anvil 56 to detonate the mix and ignite propellant 30 via flash hole 26. Also as is known in the art, the primer mix 54 may be separated from the propellant 30 by a barrier disc 58 formed of paper or other material. While one flash hole is present in the cartridge case shown in FIGS. 1 and 2, cartridge cases having more than one flash hole are known as well.

In the prior art, the live cartridge is demilitarized by first removing the bullet and then the propellant from the case. The remaining components are the cartridge case and primer, i.e., a primed case. The propellant, for example gun powder, may be used for commercial blasting. However, in order to reuse the cases to produce new or reloaded cartridges, or for scrap metal, it is necessary to remove or detonate the explosive primer mix contained therein.

One heretofore known commercial method for disposing of off-specification or excess live ammunition consisted of open burning-detonation at a designated burn area. This practice, however, produced toxic gases and material which escaped into the air and thus was ecologically unacceptable. In addition, the detonation destroyed all of the cartridge components and thus provided minimal resource recovery and scrap value. Another known method for disposing of live ammunition, to some extent, has been the use of pop-furnaces to incinerate the primed cases and destroy the primer mix (after the bullet has been taken apart and the propellant removed from the cases). The use of an incinerator or pop furnace is highly regulated by the EPA and stringent requirements must be met in order to obtain a permit for carrying out such a process. Thus, the use of pop furnaces is not a practical, viable alternative method for demilitarizing live ammunition. As such, there is a need in the art for an improved, ecologically acceptable and economical process for the demilitarization of ammunition.

SUMMARY OF THE INVENTION

The present invention provides a process and apparatus for the demilitarization of small caliber (for example, 0.30 caliber and less) primed cases in a environmentally acceptable manner. Specifically, once the bullet has been removed from the case (for example, by the use of a known RCBS rock chucker press), the propellant may be removed from each case for later use as commercial blasting slurry. Removing the bullet and propellant leaves the cartridge case with a primer including live primer mix. In the present invention, instead of burning or detonating the primer mix, the mix is selectively removed from the primed case via a chemical solution which breaks up the primer mix so that its components exit through the flash hole(s) in the case. In a further aspect of the invention, the primer mix is gathered and then chemically destructed. The removal of the primer mix from the primed cases, i.e., chemical depriming, leaves the cases inert. Thus, the demilitarization of cases permits their use for either reloading applications or metal recycling.

The typical non-corrosive composition of primer mix for small caliber ammunition consists of a primary explosive (e.g., lead styphnate, PETN, TNT), fuel (e.g., antimony sulfide, lead oxide, zirconium, calcium silicide), oxidizer (e.g., barium nitrate), and a binder material (e.g., gum arabic). The gum arabic typically constitutes less than 1% by weight of the primer mix and holds the primer mix constituents together resulting in consistent performance of the priming composition. The present invention provides chemical depriming by chemically dissolving the binder material and flushing the resulting primer mix particles out of the case and, preferably, out of the flash holes in the case. The chemical destruction of the binder, for example, gum arabic, is achieved with the use of warm 0.1N sulfuric acid solution in a most preferred embodiment.

Efficient and effective contact between the primer mix and the chemical solution is achieved by the use of an agitation device, for example, a rotating tumbler or an orbital shaker table. The rotational speed, angle and load of the agitation device preferably are set so as to produce maximum turbulence in the liquid solution while, at the same time, causing very little relative motion between the cases. Also, as there is only one port of entry in the primed case (the open end from which the bullet has been removed), the action of the agitation device preferably is such that the acid solution flushes the interior of the case in alternate cycles. Further, since the primer mix is maintained wet at all times, the inventive process is very safe in view of the fact that the primer mix is substantially rendered inert by water (i.e., as long as proper grounding procedures are followed).

In addition, once the primer mix has been removed from the cases it may be allowed to settle out and then chemically destructed, preferably by the use of a 20–40 wt % sodium hydroxide solution. The inert cases then are rinsed and dried and can be used for producing reloaded ammunition or for metal recycling. Once the cases have been chemically deprimed they are similar to fired inert cases and hence standard reloading equipment can be used. In actuality, as the chemically deprimed cases were never fired, they can be reloaded and sold as new ammunition. However, and in particular when depriming brass cases, the conditions are controlled to prevent stress corrosion cracking (SCC) of the cases, which is a significant problem with respect to brass cases and often renders the cases unsuitable for reload applications.

The present invention provides for the demilitarization of small caliber primed cases without detonation or burning of the primer mix and thus, unlike prior art processes, does not create air pollution problems. At the same time, the invention achieves maximum resource recovery, thereby justifying the cost of demilitarizing such ammunition.

BRIEF DESCRIPTION OF THE DRAWINGS

Other features, benefits and advantages of the present invention will become apparent from the following detailed description of the invention when considered in conjunction with the accompanying drawings, wherein.

DETAILED DESCRIPTION OF PREFERRED EMBODIMENTS

Figure 1:
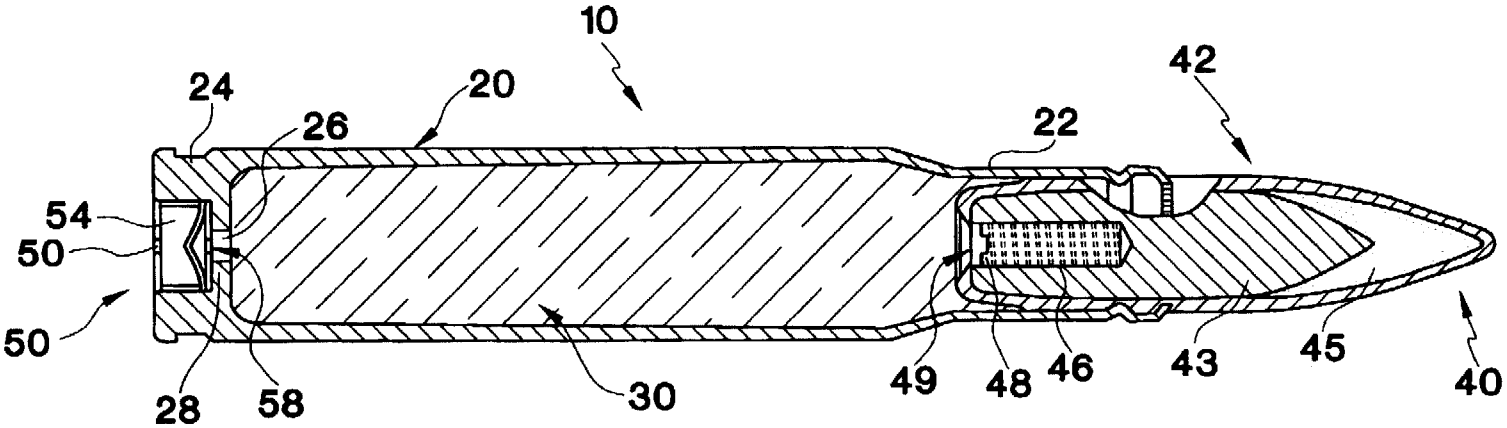
FIG. 1 PRIOR ART
FIG. 1 is a side elevation view in section of a conventional small caliber cartridge.

As discussed above, FIGS. 1 and 2 depict a conventional small caliber cartridge 10, with FIG. 2 showing the primed cartridge case 20 after the bullet 40 and propellant 30 have been removed therefrom. In the example shown in FIG. 1, the projectile 40 is a tracer bullet and includes a jacket 42, core 43, incendiary 45, tracer 46, igniter 48 and closure 49. The flight of such a bullet or projectile is visible to the human eye as is known in the art. The propellant 30 is ignited by the detonation of primer mix 54 of primer 50, which detonation is achieved by impacting the cup 52 so as to cause the primer mix to engage anvil 56 such that the resulting explosive reaction is carried through flash hole 26 to ignite propellant 30. The operation of such structure is well known in the art and thus will not be described in further detail herein.

Figure 2:
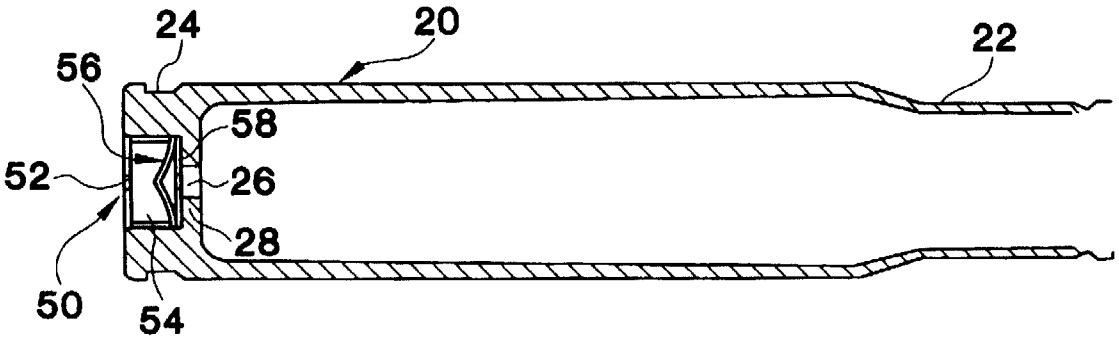
FIG. 2 PRIOR ART
FIG. 2 is a side elevation view in section of the cartridge of FIG. 1 with the bullet and propellant removed from the case.

FIG. 2 shows the cartridge case 20 which includes a narrow neck portion 22 from which the bullet 40 has been removed. The rear end 24 of case 20 has the primer 50 situated therein so as to be adjacent flash hole 26. As can be seen from FIG. 2, the primer is captured in a recess formed in rear portion 24 and, due to the primer 50 having a larger size than that of the flash hole 26, must be removed from the case via the open end of the recess (to the left in FIG. 2). As also noted above, one prior art method of demilitarizing primed cases such as that shown in FIG. 2 involves detonation of the primer mix 50. As discussed in detail below, however, the present invention permits removal of the primer mix from the case through a chemical depriming process and thus obviates the need to detonate the primer mix in order to render the primed case inert or inactive.

In a most preferred embodiment of the present invention, the chemical depriming is achieved by an agitated bath of sulfuric acid solution which chemically dissolves the binder material that holds the components of the primer mix together. It will be recognized by those skilled in the art that the process of the present invention is applicable to a variety of primer types and priming compositions, although, for exemplary sake, the preferred embodiments discussed herein refer to a particular type of primer and binder material. For example, the most commonly used primer types for small caliber ammunition are boxer primers, berdan primers, and rimfire primers. Most of the small arms ammunition in the United States (commercial as well as military) uses boxer primers, except for 0.22 caliber ammunition which utilizes rimfire primers. Boxer primers have a paper disc which acts as a seal which overlies the flash hole(s) to protect against cross contamination between the primer mix and the propellant contained in the case. However, once the primed case has been contacted with liquid the paper disc tends to shrivel up around the anvil of the primer, which in turn leaves the flash holes open and unexposed to allow the primer mix to flow forwardly out of the case upon dissolution of the binder material by the chemical solution used in the process of the present invention.

One of the most common non-corrosive priming compositions used by the United States military is FA 956 which includes the following components:

| | |
|---|---|
| Lead Styphnate, Normal | 37.0 ± 5% |
| Tetracene | 4.0 ± 1% |
| Barium Nitrate | 32.0 ± 5% |
| Antimony Sulfide | 15.0 ± 2% |
| Aluminum Powder | 7.0 ± 1% |
| PETN | 5.0 ± 1% |
| Gum Arabic | 0.2% |

The gum arabic, which binds the primer mix constituents together so as to provide consistent burn characteristics, typically constitutes only 0.2–1 wt % of the primer mix. As is known in the art, the constituents of the primer are passed through fine screens before they are mixed in the gum arabic solution. According to the present invention, the gum arabic is hydrolyzed preferably by using warm (e.g., 50° C.–100° C.) 0.1N sulfuric acid. As the gum arabic is hydrolyzed by the solution, the primer pellet breaks apart into particles; breaking the pellet apart also dramatically improves the wetting characteristics of the primer mix. Once the gum arabic has been dissolved, the barium nitrate component of the mix, being very soluble in water, also dissolves so as to further reduce the size of the primer mix particles.

Figure 3A:
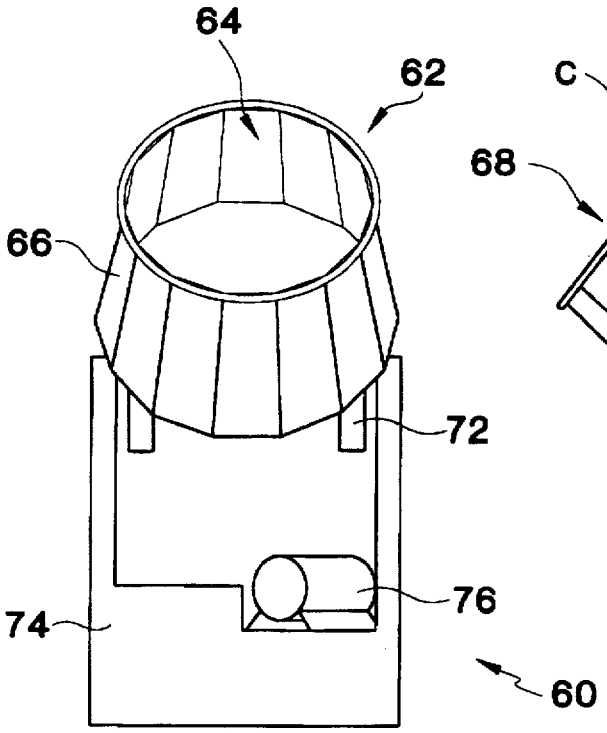
FIGS. 3A, 3B and 3C are, respectively, front and side elevation views and a plan view (taken in the direction of arrow C) of an agitation device which may be used according to one embodiment of the present invention.
Figure 3B:
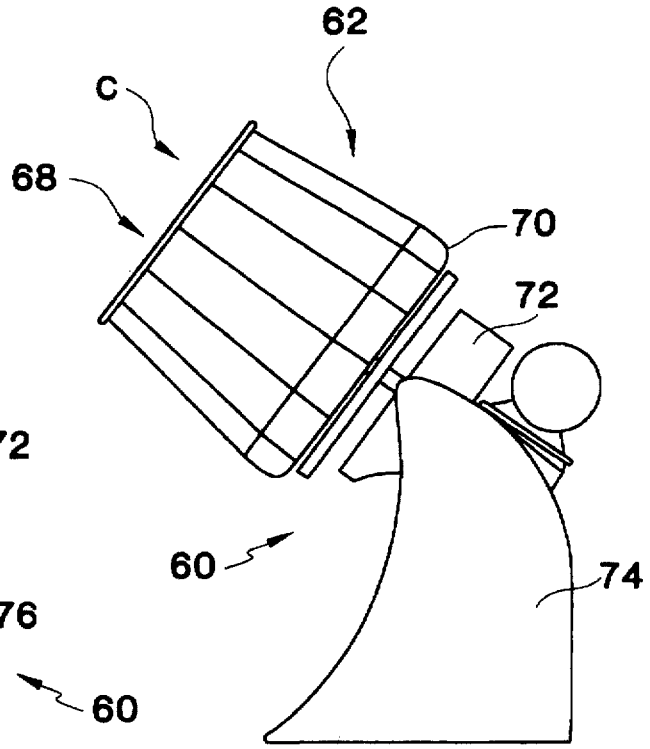
Figure 3C:
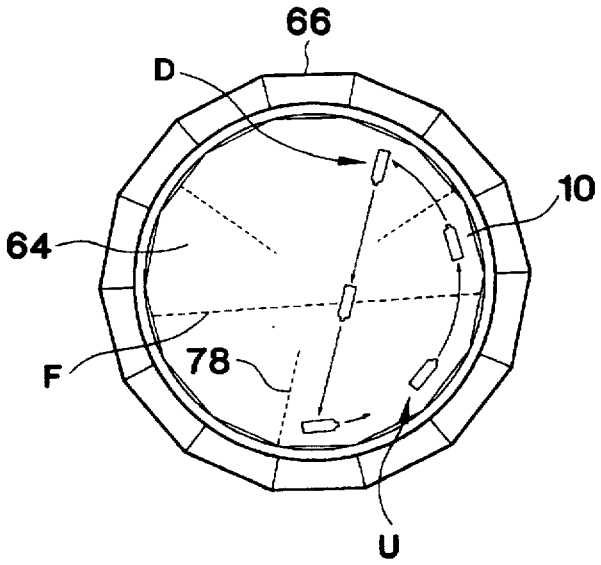

According to the present invention, the primer mix is broken into fine particles and a continuous rinsing and flushing of the fluid into and out of the cases is provided by an agitation device 60 (FIGS. 3A–3C). In particular, a preferred embodiment of the invention utilizes a rotating tumbler apparatus which includes internal baffles or flights 78 which move the primed cases through the solution so as to achieve sufficient contact of the solution with the primer mix contained in the cases. FIG. 3A shows such a tumbler apparatus 62, the structure of which is known per se, which includes an exterior 64, an exterior 66, an open end 68, and an opposite closed end 70. The tumbler 62 is thus in the form of an open-ended receptacle which is supported on a base support 74 provided with an adjustment mechanism 72 to permit adjustment of the angular orientation of the tumbler 62 with respect to a horizontal axis (and a vertical axis if desired). A motor or other drive mechanism 76 is provided to rotate the tumbler relative to the base support 74. As seen in FIG. 3C, the interior 64 of the tumbler 62 includes a plurality of baffles 78 which may be in the form of fins extending radially inward from the interior surface of the tumbler. While in a preferred embodiment three equally-spaced baffles 78 are provided, those skilled in the art, of course, will recognize that additional or fewer baffles may be utilized, equally spaced or not, which move the primed cases relative to the depriming solution.

FIG. 3C depicts a plurality of primed cases 10 as they are moved by the baffles 78 as the tumbler 62 rotates (counterclockwise in FIG. 3C). The present invention preferably moves the primed cases and the chemical solution contained in tumbler 62 in alternate cycles including a first cycle, designated by letter U in FIG. 3C, in which the cases 10 are moved upward so as to force the fluid into the open end thereof (at neck 22). Once the cases have been moved upward through the fluid as the tumbler 62 continues to rotate, they reach the beginning point of the second cycle, indicated by letter D, in which the cases essentially turn upside down and fall downward toward the fluid. The amount of solution or fluid contained in the tumbler is indicated by the dashed line F and is such that the cases 10 preferably are alternately moved through and then out of the solution. Thus, the open end at the neck of the cases 10 which faces upward in the cycle U is turned over so as to face downward in cycle D such that the chemical solution exits the interior of the cases as they move downward toward the fluid (at least some of the broken apart primer mix exiting as well, as discussed further below).

The flushing of the interior of the cases with the chemical solution preferably is enhanced by placing the solution into a turbulent liquid phase. By initiating a turbulent liquid phase, the flushing of the solution into the interior of the cases enhances the effective contact between the solution and the primer mix and improves dissolution of the binder material to facilitate breaking the primer mix into small particles which can exit the case via the flash holes. However, although agitated into a turbulent state, the solution preferably does not splash within the tumbler. Further, in small caliber cartridge cases the diameter of the neck portion is substantially small, as seen with regard to neck portion 22 in FIG. 2 as well as the neck portions of the cases 10 shown in FIG. 3C. The relatively small size of the neck of the case tends to form an air pocket inside the case which may prevent the flushing solution from entering the case. However, by initiating the solution into a turbulent liquid phase, the solution enters the open neck of the case and thereafter travels within the case so as to contact the primer mix located at the rear portion of the case.

Figure 4A:
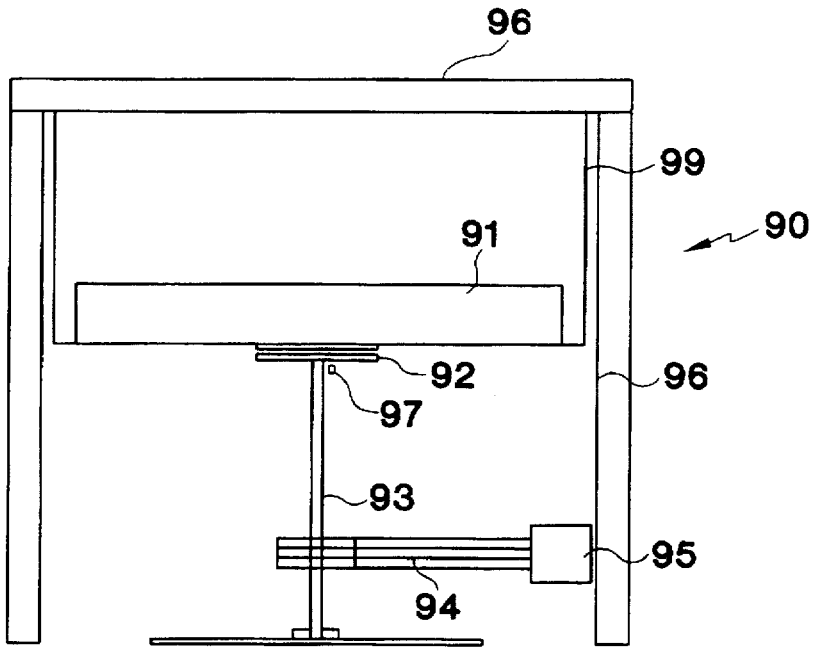
FIGS. 4A and 4B are, respectively, a front elevation view and plan view of an alternative agitation device which may be used according to the prevent invention.
Figure 4B:
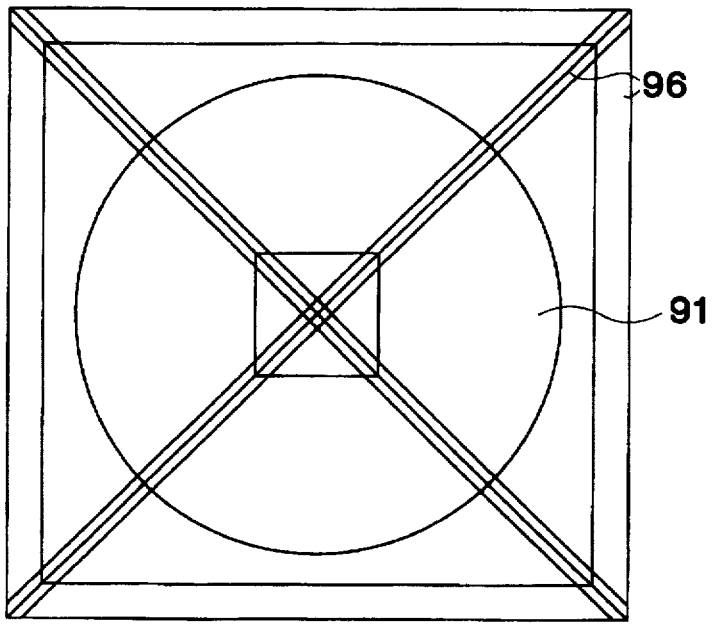

Referring to FIGS. 4A and 4B, an alternative agitation device 90 is shown which may be utilized to move the prime cases and solution relative to each other so as to effect dissolution of the primer mix binder material. In particular, agitation device 90 is in the form of an orbital shaker table which includes a rotatable container 91 for receiving the primed cases and chemical depriming solution. The container 91 is secured (either removably or permanently) to a base plate 98 so as rotate therewith. A support 92 is attached to a rotary driving member 93. One or more belts 94 are driven via a motor 95 so as to effect rotation of member 93 and support 92. The support 92 is fixed to the base plate 98, for example by a removable pin 97, such that rotation of member 93 and support 92 rotates plate 98 and container 91. The pin 97 is located away from the axis of rotation such that the container 91 is rotated in an off-center manner. The rotation of the container 91 in an eccentric or off-center manner serves to agitate the chemical solution contained therein into a turbulent state and facilitates flushing of the solution into the interior of the primed cases which are located in container 91. Thus, the chemical solution is flushed into the interior of the cases where it contacts the primer mix so as to dissolve the binder material thereof to facilitate breaking the primer mix into small particles which can be removed through the flash holes of the cases. A frame 96 preferably is provided for structural support and may enclose the periphery of the device. Suitable support members 99 may be provided to suspend the base plate 98 (and container 91) from the frame 96.

Figure 5:
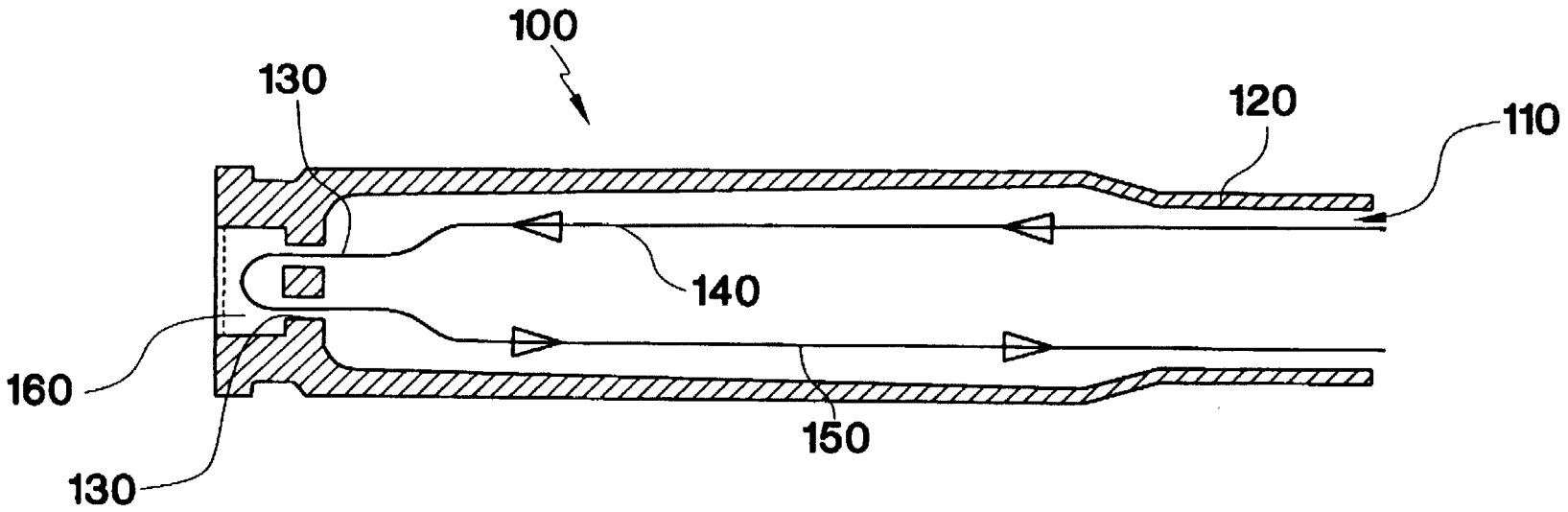
FIG. 5 is a sectional view of a case which illustrates schematically the flow of chemical depriming solution into and out of the case.

FIG. 5 is a sectional view of a primed cartridge case 100 which schematically illustrates the flow of the chemical flushing solution into and out of the case so as to dissolve the primer mix binder material during the preferred embodiment described above. In particular, case 100 includes an open end 110 located at neck portion 120, and a rear portion in which is defined a recess or compartment 160 in which the primer is disposed. The outer end of compartment 160 is closed by the end of the cup-shaped primer as indicated schematically by the dashed lines. Flash holes 130 form a through passage extending from the primer compartment 160 into the interior of the case in which is located the propellant (which has been removed from the case 100 shown in FIG. 5). The chemical flushing solution, which, as discussed above, preferably is warm sulfuric acid solution, is agitated into a turbulent liquid state and enters the case via open end 110 so as to follow a path denoted by arrows 140. The contact of the solution with the paper disc (not shown) of the primer located adjacent flash holes 130 causes the paper to shrivel or shrink about the anvil of the primer thus leaving the flash holes open, as discussed above. The sulfuric acid solution passes through the flash holes so as to effectively contact the primer mix located in compartment 160. The result of such contact is that the binder material, for example, gum arabic, is dissolved as discussed above.

The turbulent liquid state into which the solution is placed further enhances contact of the solution with the primer mix so as to facilitate dissolution of the binder material. The result is that the primer mix is broken into pieces or particles all or most of which are small enough to pass through the flash holes from compartment 160 into the interior of the case in the direction of arrows 150. Thus, the explosive primer mix pellet is dissolved and exits the case via open end 110. Despite the fact that the neck 120 of such caliber cases is relatively small and does not present a large opening by which the solution can enter the interior of the case, the turbulent liquid state into which the solution is placed by the above-described agitation devices serves to permit the solution to enter open end 110 and turbulently flush the interior of the case so as to sufficiently wet and contact the primer mix located at the rear of the case. By controlling various factors including the amount and temperature of the chemical solution, the angular position and rotative speed of the tumbler apparatus (or orbital shaker table), and the duration of time for which the chemical depriming process is carried out, the process achieves excellent results in breaking up the primer mix so as to allow its removal from the case and, in addition, renders inert any primer mix which remains in the case due to the contact of same with the chemical de-priming solution.

Figure 6:
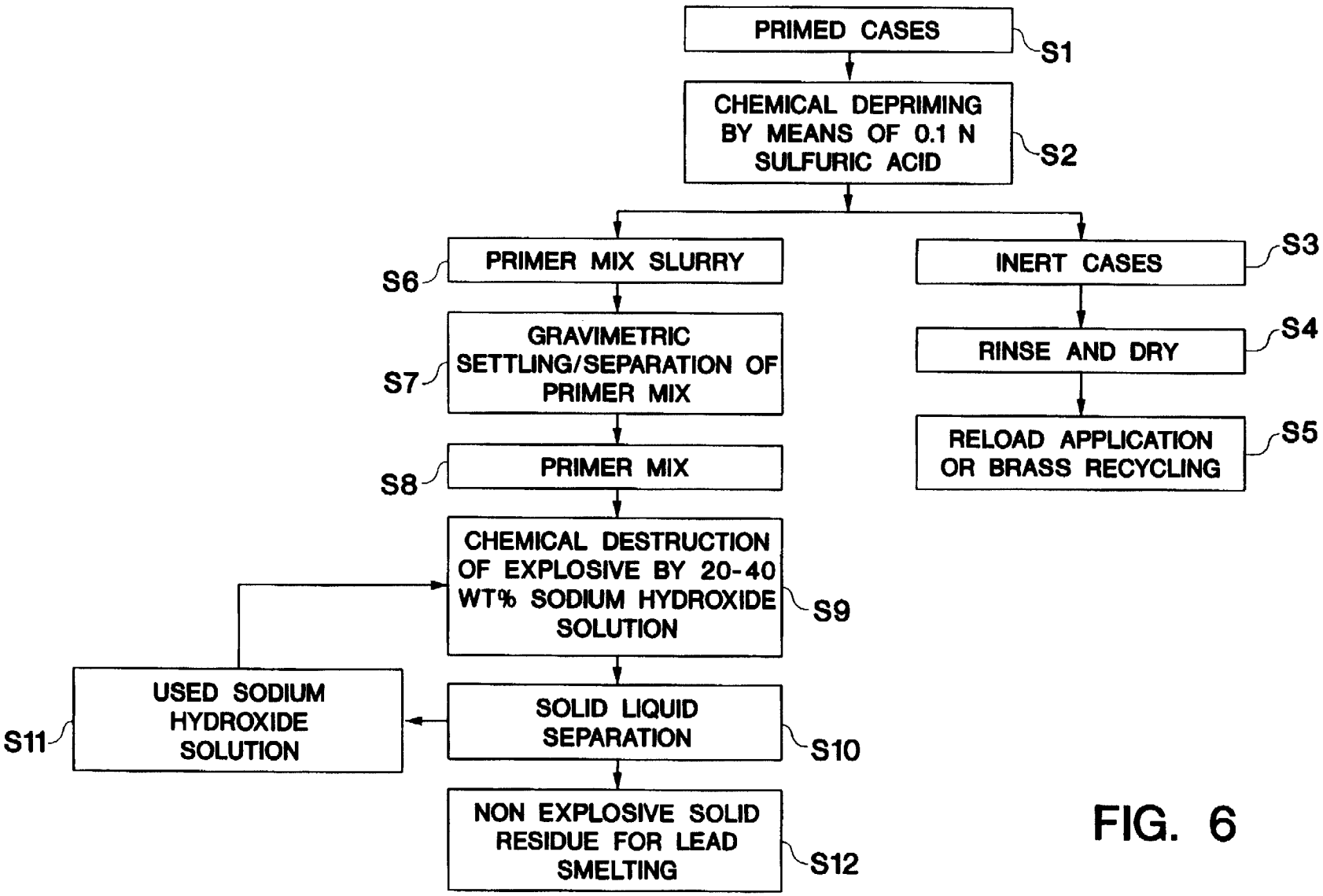
FIG. 6 is a flow chart showing a process for demilitarizing ammunition according to a preferred embodiment of the invention.

FIG. 6 is a flowchart depicting the process of the invention according to one preferred embodiment thereof. The primed cases from which the bullet or projectile and propellant have been removed (step S1) are placed in an agitation device and are chemically deprimed by means of the warm sulfuric acid solution as indicated at step S2. The resulting cases which have been rendered inert by the chemical depriming process are indicated at step S3, which inert cases are rinsed and dried as seen at step S4, thereby rendering the cases suitable for reload applications or brass recycling as indicated at step S5 (assuming the cartridge cases are made of brass).

In addition to the above-described chemical depriming aspects of the present invention, the primer mix which has been removed from the cases may be collected in a slurry as indicated at step S6 and subjected to a gravimetric settling/separation procedure (step S7) which separates the explosive primer mix as indicated at step S8. The explosive primer mix preferably is reacted with a 20–40 wt % sodium hydroxide solution so as to chemically destroy the explosiveness of the primer mix (step S9). The product of the chemical reaction of step S9 is completely inert and may then be subjected to a solid liquid separation process indicated at step S10 which results in a non-explosive solid residue suitable for lead smelting as indicated at step S12. The liquid which is separated from the product of the reaction of S9 may be collected at step S11 and reused for the chemical destruction of the explosive primer mix carried out at step S9. Those skilled in the art will recognize that the present invention provides a process for chemically depriming live cartridge cases so as to produce inert cases suitable for reload applications, recycling or scrap material. The process steps S6–S12 for chemically rendering inert the explosive primer mix which has been removed from the cases (via process steps S1–S5) is known per se. The chemical depriming process of steps S1–S5, of course, may be carried out irrespective of the chemical destruction process of steps S6–S12.

A particular advantage of the present invention is that it may be carried out to permit the chemical depriming of brass cartridge cases without subjecting such cases to stress corrosion cracking (SCC). As is known by those skilled in the art, SCC is a significant problem which often arises during the chemical treatment of brass.

As previous research has shown, the SCC susceptibility of admiralty brass (brass used for cartridge cases) depends on the oxidizing power of the oxyanion, size of the anion, solubility of its copper salt, moisture present, and duration of exposure. The $NO_3^-$ and the $SO_4^-$ anions are present in the solution from barium nitrate and sulfuric acid and are among the more severe anions that cause SCC because of their oxidizing property and the fact that their copper salts are soluble in water. Therefore, in order to prevent SCC during chemical depriming, the exposure time preferably is limited. Also, as the oxidizing property of the oxyanion increases with temperature, it is advisable to operate at lower temperatures (e.g., 50° C. to 65° C.).

Therefore, for the most preferred application of the present chemical depriming process to reload brass, the following parameters should be realized:

1) The primer should include a paper disc (as opposed to plastic) which shrivels up when in contact with fluid so as to unblock the flash holes;

2) The primer composition should include gum arabic as the binder material; and

3) The agitation device should be efficient enough to limit the exposure time of the brass to less than one hour at moderate temperatures (e.g., 50° C. to 65° C.).

Once the primer mix has been removed from the primed cases, the cases should be rinsed and dried to prevent any further corrosion of the brass. The cases then can be processed through standard reloading equipment as they are completely inert or, alternatively, may be salvaged as scrap brass. In addition, the primer mix may be permitted to settle and then desensitized using 20–40 wt % sodium hydroxide solution (as described above). Also, with respect to the latter process, it should be noted that it is important to have continuous agitation of the sodium hydroxide solution at a temperature below 180° F. for an efficient and safe chemical destruction process. An example of the process of the present invention will now be described.

EXAMPLE

Ten thousand 0.30 caliber primed brass cases containing FA 956 priming mix composition were chemically deprimed using a 20 cubic ft. 316 stainless steel tumbler. The acid solution was prepared by adding 150 ml of 98% pure sulfuric acid to 12 gallons of tap water and heating the solution to 60° C. The tumbler was tilted at approximately 30° from horizontal so that there was no splashing during rotation. The tumbler rotation was geared at 40 rpm with the base diameter of 30 inches. The tumbler had three equally spaced baffles which, from the base to the tip of the tumbler, were 1 inch high. The tumbler was allowed to run for 45 minutes.

After the chemical depriming process was carried out in the tumbler, the cases were rinsed and dried immediately. Twenty cases were randomly selected and flame tested; no explosive residue was found. Twenty cases were sent out to H. P. White Laboratory Inc. to be examined for SCC. The cartridge cases were tested in accordance with the requirements of SCATP-5.56, U.S. ARMY TEST PROCEDURES OF 5.56 MM CARTRIDGE (Ammunition Ballistic Acceptance Test Method), dated July 1974. Results of testing performed by H. P. White Laboratory, Inc. indicated minor tumbling marks and surface pitting on all twenty cartridge samples; however, the results indicated no cracking or splitting indicative of residual stresses.

In addition, the primer mix was allowed to settle down for twenty-four hours and then was reacted with 40 wt % sodium hydroxide solution in an agitated bath. The temperature was controlled between 150° to 180° F. with the use of steam. The reaction was allowed to proceed for 8 hours before the reaction mixture was allowed to cool. A small amount of solid reaction product was dried and placed on a heated hot plate to check for its explosivity. The reaction product was determined to be completely inert.

While preferred embodiments of the present invention have been described in detail above, it should be recognized that such description is to set forth a complete disclosure of the present invention and does not limit the scope thereof which is defined by the following claims, persons skilled in the art appreciating that many variations and permutations are possible without departing from the spirit and scope of the invention defined therein.

We claim:

1. A process for removing explosive primer mix from primed cartridge cases, the process comprising steps of:

providing at least one cartridge case which includes explosive primer mix, the primer mix including a binder for holding the mix together;

providing a chemical solution for dissolving the primer mix contained in the primer of the cartridge case;

providing an agitation device configured to hold the cartridge case and the chemical solution;

filling the agitation device with a predetermined amount of the chemical solution;

placing the cartridge case in the agitation device; and moving the case and the chemical solution relative to each other in the agitation device for a length of time sufficient to substantially dissolve the binder to break the primer mix into particles at least some of which are flushed from the case.

2. A process according to claim 1, wherein the cartridge case is a small caliber case.

3. A process according to claim 1, wherein the chemical solution is a sulfuric acid solution and the binder is gum arabic.

4. A process according to claim 3, wherein the chemical solution is 0.1N sulfuric acid solution.

5. A process according to claim 3, wherein the acid solution is heated to a temperature within a range of about 50° to 65° C.

6. A process according to claim 5, wherein a plurality of cases are positioned in the agitation device, and the agitation device supports the cases so as to substantially prevent the cases from contacting each other during operation of the agitation device.

7. A process according to claim 1, wherein the agitation device is an orbital shaker table which supports the case within the chemical solution and is activated to flush the case with chemical solution in a turbulent state.

8. A process according to claim 1, wherein the agitation device is a rotatable tumbler which rotates at a desired speed and is disposed at a desired angular position so as to move the case through the chemical solution in cycles to flush the primer mix from the case.

9. A process according to claim 8, wherein as the case is moved and the solution enters an open front end of the case, travels toward the primer mix located adjacent the rear end of the case, and flushes the dissolved primer mix through at least one flash hole located adjacent the rear end of the case.

10. A process according to claim 1, wherein the agitation device moves the case in alternate cycles including a first cycle in which the chemical solution enters the open front end of the case and a second cycle in which the chemical solution exits the open front end of the case along with at least a portion of the primer mix.

11. A process according to claim 1, wherein the chemical solution is placed in a turbulent liquid phase and enters the case and flushes at least a portion of the primer mix through at least one flash hole in the case and out of the front end of the case.

12. A process for chemically removing live primer mix from brass cartridge casings while preventing the casings from developing stress-related cracking, the process comprising steps of:

providing brass cartridge casings which are hollow and have an open front end and a rear end, the rear end holding a primer including primer mix, wherein at least one flash hole is located in the casing adjacent to the primer, and wherein the primer mix includes a binder material which holds the primer mix constituents together;

providing an acid solution for dissolving the binder material of the primer mix;

placing the brass casings in a receptacle which contains a supply of the acid solution;

agitating the acid solution and flushing the solution into and out of the brass casings to dissolve the binder material and remove at least some of the primer mix from the brass casings; and controlling the temperature of the acid solution and the time that the casings are exposed to the acid solution to prevent stress-related cracking of the brass casings.

13. A process according to claim 12, wherein the brass casings include a paper seal which overlies the at least one flash hole, and the acid solution causes the paper to uncover the flash hole to permit the acid solution to contact the primer mix and to permit at least some of the dissolved primer mix to exit the casing through the flash hole.

14. A process according to claim 12, wherein the acid solution is a sulfuric acid solution.

15. A process according to claim 12, wherein the acid solution is 0.1N sulfuric acid solution.

16. A process according to claim 15, wherein the binder material is gum arabic.

17. A process according to claim 15, wherein the temperature of the acid solution is in a range of from about 50° to 65° C., and the brass casings are exposed to the solution for less than an hour.

18. A process according to claim 12, wherein the casings are supported by the receptacle so that the casings are substantially prevented from contacting each other during flushing of the solution into and out of the cases.

19. A process according to claim 12, wherein the receptacle is a rotatable tumbler which contains the acid solution and moves the casings relative to the solution at a predetermined angle and speed.

20. A process according to claim 19, wherein the tumbler has an interior which includes baffles which move the casings through the solution, and the casings are moved in alternate cycles including a first half during which turbulent acid solution enters the open end of the casing and a second half during which the acid solution exits the open end of the casing.

21. A process according to claim 12, further comprising a process of desensitizing the primer mix removed from the casings, said process including steps of:

allowing the primer mix to settle after being removed from the casings;

chemically reacting the settled primer mix with sodium hydroxide solution for a predetermined length of time and at a predetermined temperature to destroy the explosivity of the primer mix; and producing a substantially completely inert product as a result of the chemical reaction.

22. A process according to claim 21, wherein a 20–40% by weight sodium hydroxide solution is reacted with the primer mix in an agitated bath and at a temperature less than about 180° F.

* * * * *